US006123052A

United States Patent [19]

Jahn

[11] Patent Number: 6,123,052

[45] Date of Patent: Sep. 26, 2000

[54] WAFFLE CAST IRON CYLINDER LINER

[76] Inventor: George Jahn, 115 Stevens St., Springfield, Mass. 01104-3196

[21] Appl. No.: 09/373,009

[22] Filed: Aug. 12, 1999

Related U.S. Application Data

[60] Provisional application No. 60/098,207, Aug. 27, 1998.

[51] Int. Cl.[7] ..... F02F 1/14; F02F 1/10; B21K 3/00

[52] U.S. Cl. ..... 123/41.79; 123/41.84; 123/193.2; 29/888.01; 29/888.061

[58] Field of Search ..... 123/41.79, 41.84, 123/193.2; 29/888.061, 888.01

[56] References Cited

U.S. PATENT DOCUMENTS

| | | | |
|---|---|---|---|
| 3,165,983 | 1/1965 | Thomas | 123/193.2 |
| 5,189,992 | 3/1993 | Hama et al. | 123/41.84 |
| 5,207,188 | 5/1993 | Hama et al. | 123/41.79 |
| 5,251,578 | 10/1993 | Kawauchi et al. | 123/41.84 |
| 5,732,671 | 3/1998 | Takami et al. | 123/193.2 |

*Primary Examiner*—Andrew M. Dolinar
*Assistant Examiner*—Katrina B. Harris
*Attorney, Agent, or Firm*—Deborah A. Basile

[57] ABSTRACT

A cast iron cylinder liner for use in an engine block. The liner is cast to have a number of longitudinal grooves and machined to have a number of intersecting annular grooves to create an inverted waffle-like pattern of ridges and grooves on the outer circumferential surface of the liner. This pattern significantly increases the surface area through which cooling of the liner occurs and, thus, increases the liner's cooling capacity by approximately 30 to 40 percent. In addition, the pattern of ridges and grooves acts as a locking mechanism whereby the liner will not move within the cylinder block.

4 Claims, 6 Drawing Sheets

WAFFLE CAST IRON CYLINDER LINER

The Applicant seeks the priority filing date of his Provisional Patent Application filed on Aug. 27, 1998, Ser. No. 60/098,207.

BACKGROUND OF THE INVENTION

1. Field of the Invention

The present invention relates to the cylinder liner of an engine block in any internal combustion engine.

2. Information Disclosure Statement

Currently, in the industry, there are cylinder liners known to the inventor which address the need to cool internal combustion engines and electric motors. No known device addresses the specific needs of producing an environmentally friendly engine and a more efficient cylinder driven motor by producing a structurally improved cylinder liner that increases the liner's cooling capacity, makes the liner more efficient and less costly to produce, and offers a higher degree of stability when embedded in an aluminum cylinder block.

In an internal combustion engine there are cylinders located within a cylinder block and pistons ride up and down within the cylinder liners. The pistons riding up and down compress the gas with oxygen to fire the fuel causing combustion which drives the crank shaft which turns the journals and converts linear motion to rotary motion. The process requires air, gas, and compression to combust or create energy to cause the drive shaft to move. This process results in the creation of heat. The heat must be dissipated or moved away from the engine in order to promote efficiency and keep the engine cool enough to run.

In other than an internal combustion engine, the compression is fired by electricity. The present invention can be utilized whenever a piston rides inside a cylinder and the cylinder has to be cooled to keep an engine running. It does not have to be an internal combustion engine; it can be a compressed air motor, or any other type of motor.

In a combustion engine, the cylinder within which the piston fires is placed within a cylinder liner made of cast iron which is durable and heat tolerant. The cylinder liner becomes an integral part of the aluminum cylinder block. Different engine manufacturers use different block designs and methods of manufacture. The properties of cast iron and aluminum are very different and for this reason, the adhesion between the cylinder liner and the cylinder block must be locked within each other securely otherwise the point of connection between the liner and the block may be damaged by heat or vibration generated with the operation of the internal combustion engine resulting in damage or separation between the block and the cylinder liner causing engine knocking and inefficient firing.

To eliminate this disadvantage, the prior art includes cylinder liners having grooves or unevenness on their outermost surface to enhance the adhesion between the cylinder liner section and the cylinder block. The present invention's waffle design is an improvement over the prior art in that the increased surface area and its pattern serves to increase adhesion of the locking mechanism between the liner and the block, as well as to increase surface area for heat dissipation and therefore increase the effectiveness of the air or liquid coolant.

The following patents are known to the Inventor and are disclosed:

1. U.S. Pat. No. 5/537,969, Hata et al., Cylinder sleeve layer cast in cylinder barrel.

2. U.S. Pat. No. 5/251,578, Kawauchi et al., Cylinder liner with annular and longitudinal grooves.

3. U.S. Pat. No. 5/207,189, Kawauchi et al., Cylinder liner with annular and longitudinal grooves.

4. U.S. Pat. No. 5/207,188, Hama et al., Cylinder liner with longitudinal and circumferential grooves.

5. U.S. Pat. No. 5/199,390, Hama, Cylinder liner with annular and longitudinal grooves.

6. U.S. Pat. No. 5/189,992, Hama, Cylinder liner with annular and longitudinal grooves.

7. U.S. Pat. No. 5/176,113, Hama et al., Cylinder liner with annular and longitudinal grooves.

8. U.S. Pat. No. 5/005,469, Ohta, cylinder liner of cast iron casted in aluminum block.

9. U.S. Pat. No. 4/983,652, Field et al., Iron cylinder cast in aluminum block.

10. U.S. Pat. No. 1/321,792, Jackson, Cylinder liner with longitudinal and circumferential grooves.

The following Japanese patents also constitute prior art:

1. JP-280,413, Cylinder liner with longitudinal and circumferential grooves.

2. JP 4-153,549, Cylinder liner with lateral and longitudinal ribs.

SUMMARY OF PRIOR ART

The prior art does not teach a cast iron cylinder liner having a plurality of annular and longitudinal grooves creating a waffle effect which is built into and becomes an integral part of the cylinder block to increase surface cooling area and to lock the liner securely within the block. In large part, the prior art discloses various channeling methods through which coolant flows to cool the engine which are within the block. The prior art does not attempt to address increasing the surface area of the liner to increase the cooling function and, simultaneously to lock the liner within the block.

In addition, these liners are completely machined. There is no process for forming a liner known to the inventor other than machining the liner to its desired shape.

OBJECTS OF THE INVENTION

It is an aim of the present invention to provide a cylinder liner that is more efficient, less costly to produce, offers a higher degree of stability when embedded in an aluminum housing which translates into a more environmentally friendly engine and a more efficient cylinder driven motor. The invention accomplishes these primary objectives:

A primary objective of the present invention is to provide a cylinder liner which in and of itself, without regard for the channeling found in the cylinder block, has increased surface area, to increase the cooling capacity of the engine.

A further objective of the present invention is to provide a cylinder liner which, due to the same feature which accomplishes the objective above, also locks securely and immovably within the cylinder block.

A further objective of the present invention is to provide a cylinder liner which requires very little machining following casting which decreases the cost of manufacturing the liner and avoids environmental hazards caused by lubrication fluids.

A further objective of the present invention is to provide a cylinder liner which for the above mentioned reasons increases fuel efficiency.

The above, and other objects, features and advantages of the present invention will become apparent from the following description read in conjunction with the accompanying drawings.

BRIEF SUMMARY OF THE INVENTION

Briefly stated, the present invention is a cylinder liner that can be cast into an engine block to remain rigidly fixed, locked and stable within the block and to dramatically increase its efficiency and the overall efficiency of the engine by providing a dramatic increase in the surface cooling area on which the engine coolant system works. The Waffle Cast Iron Cylinder Liner solves several problems as it provides a totally secure cylinder liner.

1. Locking

Prior cylinder liners are placed into cylinder blocks by keeping the block and the engine hot while cooling the liner. The liner is immersed in a nitrogen bath to cool and shrink the liner so that it can be pushed into the block. The liner, however, is not locked into the block with such a method. Rather, the liner loosens and rattles once the system returns to normal operating conditions.

On the other hand, the Waffle Cast Iron Cylinder Liner is locked inside the cylinder block. The liner is placed into a block mold into which liquid aluminum is poured. The aluminum surrounds the cylinder line and solidifies to form a block around the liner. When formed as such, the liner cannot loosen or rotate, and there is no rattling.

2. Minimal Machining

The amount of machining required by the Waffle Cast Iron Cylinder Liner is significantly decreased, which provides two benefits: 1) the manufacturing costs are decreased and 2) environmental hazards resulting from machining are decreased.

Unlike other cylinder liners that are completely machined to a smooth surface at great cost, the present liner requires minimal machining and results in significant cost savings per liner. In addition, in other cylinder liners having grooves, all the grooves are machined. During such machining processes, lubrication fluids are required. The lubrication fluid of choice contains materials which are considered environmentally harmful. Also, during the machining process, chips and splinters of cast iron are machined off of the liner. These chips and splinters become interspersed within the lubrication fluids to such an extent that they cannot be removed from the used lubrication fluid. These machined chips and splinters are contaminated and cannot be recycled. Rather, they must be washed, creating further contamination with and to the wash water. In addition, when cast iron machined chips and splinters are molten, contaminants are released into the atmosphere.

Eliminating or severely limiting the amount of machining, eliminates or severely limits the environmental hazards associated with this process.

3. Cooling Capacity

The Waffle Cast Iron Cylinder Liner provides enhanced cooling capacity by providing an estimated 30 to 40 percent more surface area from which heat is extracted by the engine's cooling system.

When placed in a mold into which molten aluminum is poured, the cylinder liner becomes an integral part of the finished aluminum casting. The square shaped projections protrude and are embedded into the aluminum providing an estimated 30 to 40 percent more surface area between the two dissimilar metals (the aluminum and the cast iron). Excessive heat within the engine results in engine failure and non-performance. The additional cooling capacity offered by the Waffle Cast Iron Cylinder Liner results in increased engine life, higher engine efficiency and less maintenance; all of which decrease fuel and oil consumption and ultimately have an environmental advantage. The Waffle Cast Iron Cylinder Liner will allow the engine to run at a lower temperature than other designs, which seem only to address how secure the liner stays in the housing. The Waffle Cast Iron Cylinder Liner addresses both superior adhesion and increased cooling capacity.

In summary, the Waffle Cast Iron Cylinder Liner is more efficient, less costly to produce, offers a higher degree of stability when embedded in an aluminum housing which translates into a more environmentally friendly engine and a more efficient cylinder driven motor.

BRIEF DESCRIPTION OF THE DRAWINGS

These and other features, aspects and advantages of the present invention will become better understood with regard to the following description, appended claims, and accompanying drawings where:

DETAILED DESCRIPTION OF THE DRAWINGS

Figure 2:
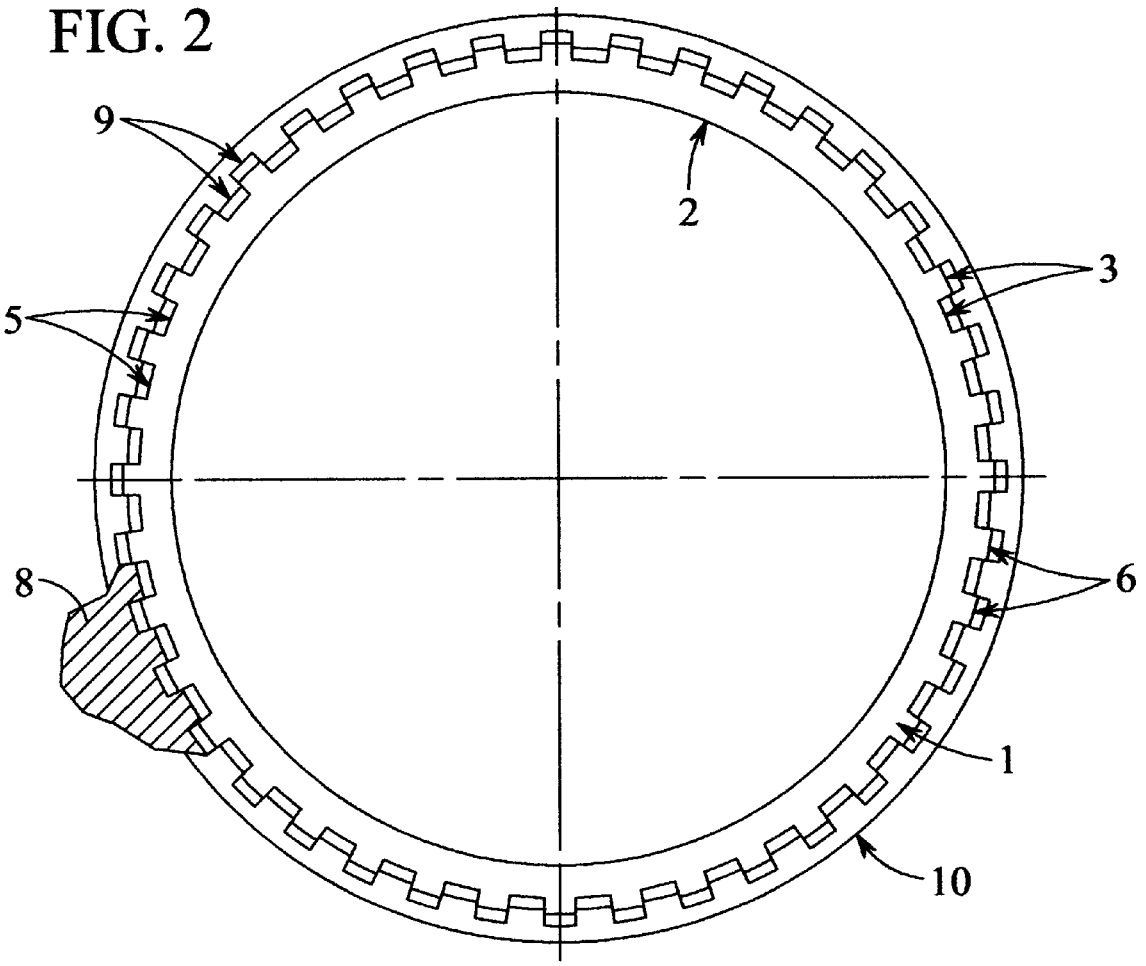
FIG. 2 is a cross section of a cylinder liner within a cylinder block.
Figure 3:
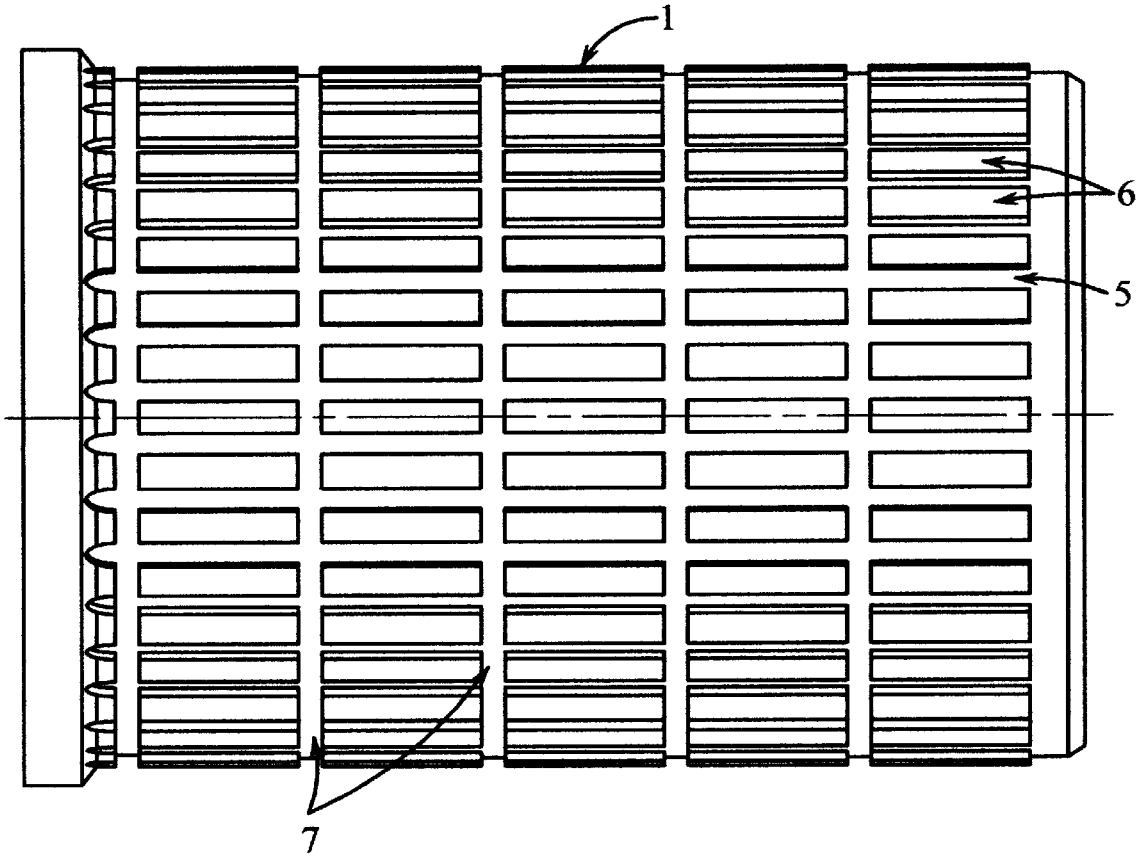
FIG. 3 is the cylinder liner showing a plurality of cast longitudinal grooves and machined annular grooves at regular intervals.
Figure 4:
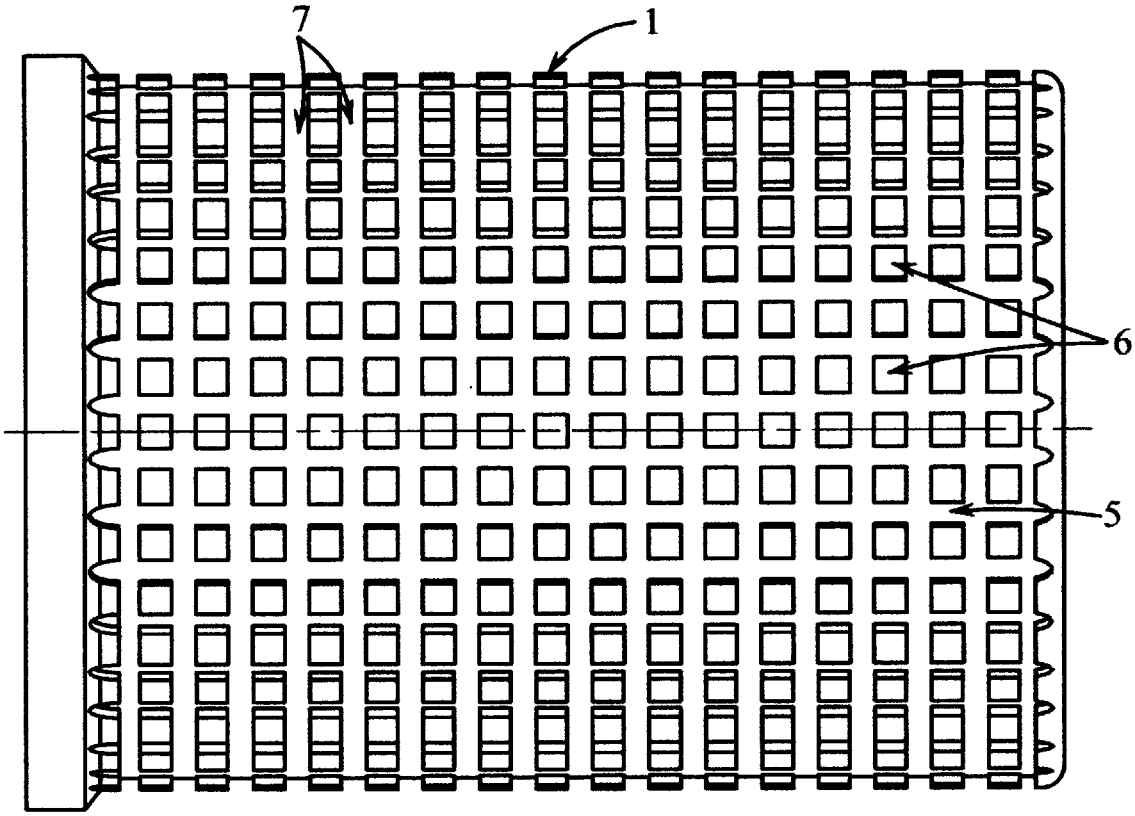
FIG. 4 is the cylinder liner as in FIG. 3, with more machined annular grooves.

Referring to FIGS. 2–4 is the cylinder liner 1 in accordance with the invention. Preferably, the cylinder liner 1 is fabricated of cast iron.

The cylinder liner 1 is a hollow elongate cylinder having an inner circumferential surface 2 having a length x and a thickness y. The length and the thickness vary depending on the type of engine. Typically, the length x is in the range of three to twelve inches.

The elongate hollow cylinder has an inner circumferential surface 2, and an outer circumferential surface 3. A plurality of longitudinal grooves 5 are formed in the outer circumferential surface 3 and extend linearly along the length of the elongate hollow cylinder. Also in the outer circumferential surface 3 are a plurality of annular grooves 7 extending in a circumferential direction along the elongate hollow cylinder. The number of longitudinal and annular grooves 5, 7 will differ depending on the needs of the customer. The greater the number of annular and longitudinal grooves, the greater the surface area, and the greater the cooling capacity of the liner. The longitudinal grooves 5 intersect the annular grooves 7 to form a plurality of ridges 6 in the outer circumferential surface 3 of the elongate hollow cylinder to form an inverted waffle-like pattern.

Figure 1:
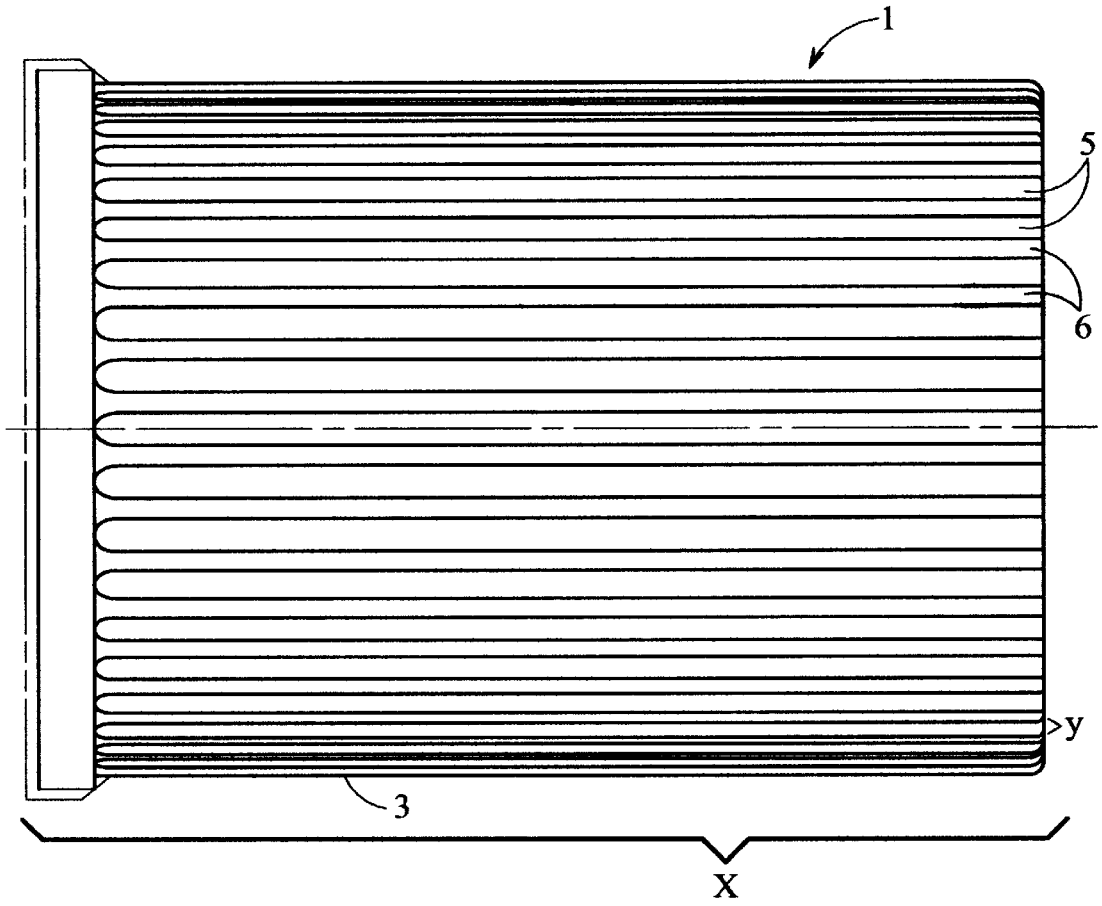
FIG. 1 is a cylinder liner showing a plurality of cast longitudinal grooves and ridges in the outer circumferential surface.

In making the iron cylinder liner 1, cast iron is poured into a mold to form the cylinder liner 1 having a plurality of longitudinal grooves 5 cast in the cylinder liner outer circumferential surface 3. These longitudinal grooves 5 extend linearly along the length of the cylinder liner 1 and are spaced equally or unequally apart from each other along the axis of the cylinder liner 1. The longitudinal grooves 5 are preferably of uniform depth v. The depth preferably ranges from one-eighth of an inch to one thirty-second of an inch, and is most preferably about one sixteenth of an inch. The resulting cylinder liner 1 has a smooth inner circumferential surface 2 and an outer circumferential surface 3 having cast alternating longitudinal grooves 5 and ridges 6. The thickness at the longitudinal grooves 5 is x-v, and the thickness at the ridges 6 is y. The resulting cylinder liner 1 is shown in FIG. 1.

The liner is then turned 90° to a horizontal position and a plurality of annular grooves 7 are machined around the circumference of the liner 1. The annular grooves 7 are spaced apart from each other at any equal or unequal intervals along the length of the cylinder liner 1. Preferably, the annular grooves 7 are perpendicular to the longitudinal grooves 5. The annular grooves may have a depth v and width w equal to the depth and width of the cast longitudinal grooves 5.

The longitudinal grooves 5 intersect the annular grooves 6 to form a plurality of ridges 7 in the outer circumferential surface 3 of the elongate hollow cylinder. The number, size and shape of the ridges depends upon the number and placement of the longitudinal and annular grooves 5, 7. Closely spaced annular grooves 7 form a greater number of smaller sized ridges 6. For example, as shown in FIG. 3, seventeen annular grooves 7 can be machined to form a number of small square shaped ridges 6. Annular grooves spaced farther apart form a small number of larger ridges 6. For example, as shown in FIG. 4, six annular grooves 7 can be machined to form a number of large rectangular shaped ridges 6. The resultant liner 1 has an outer circumferential surface 3 with an inverted waffle-like pattern: the ridges 6 having a thickness of x and the longitudinal and annular grooves 5, 7 having a thickness x-y.

Unlike other cylinder liners that are completely machined to a smooth surface at great cost, or that are completely machined with grooves, the present liner requires minimal machining. The present liner is cast and the longitudinal grooves 5 are also cast. The only machining required is that of machining the annular grooves 7.

Figure 5:
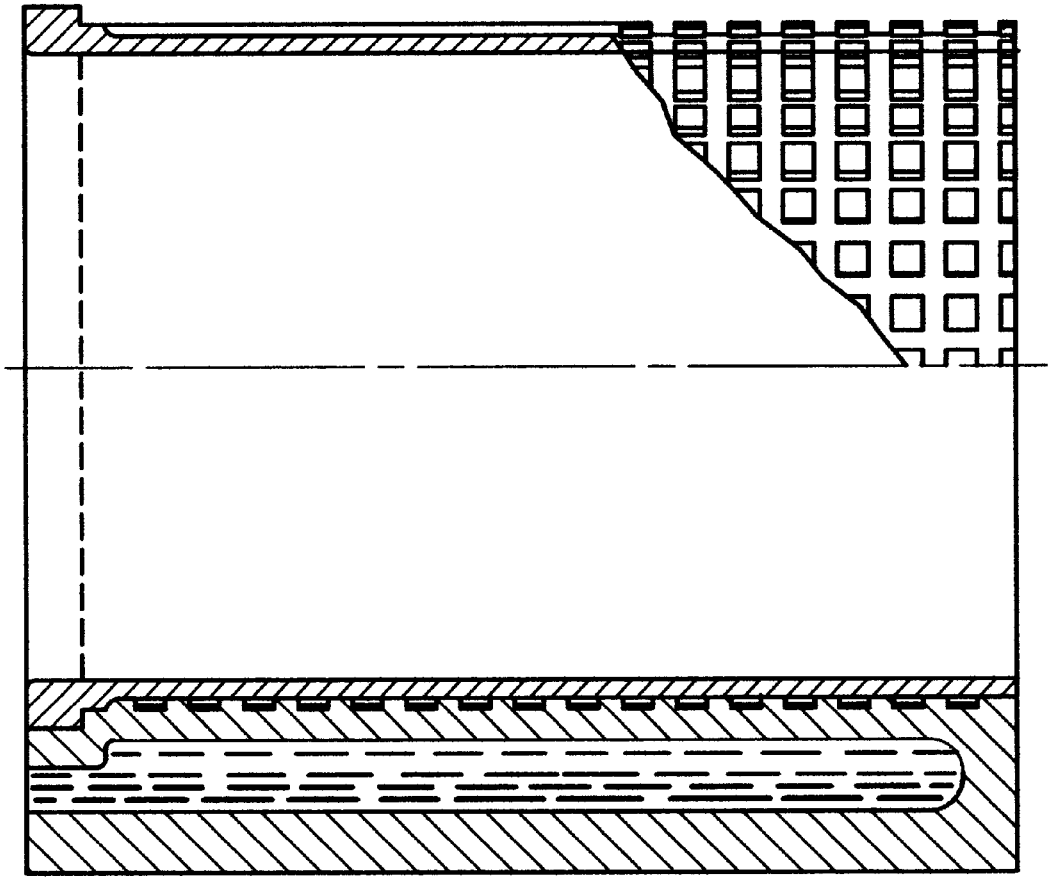
FIG. 5 is the cylinder liner in cylinder block, dry system.
Figure 6:
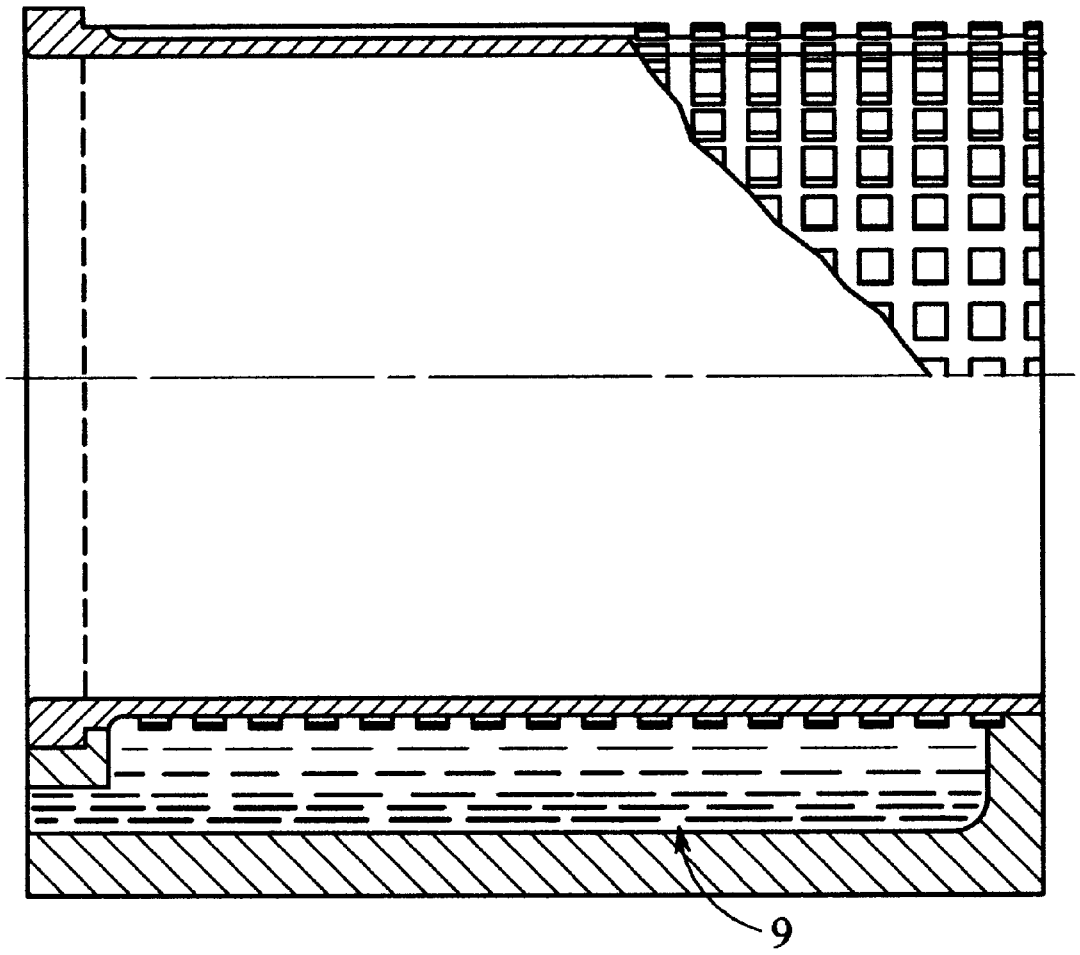
FIG. 6 is the cylinder liner in cylinder block, wet system.

After the cylinder liner 1 is formed, it is then placed in a cylinder block mold to form the cylinder block 8. Preferably, molten aluminum is poured into the mold to form an aluminum cylinder block 8. As shown in FIGS. 5 & 6 the cylinder block 8 has an inner surface 9 in contact with the cylinder liner outer circumferential surface 3 and an outer surface 10.

For a dry system, the molten aluminum flows into the longitudinal and annular grooves 5, 7, and surrounds the ridges 6. Thus, portions of the cylinder block inner surface 9 protrude into the longitudinal and annular grooves 5, 7 of the cylinder liner 1. Likewise, the ridges 6 of the cylinder liner 1 protrude into portions of the cylinder block inner surface 9. Preferably, adhesion between the cylinder liner 1 and the cylinder block 8 is increased by preventing gaps from forming between the outer circumferential surface 3 of the cylinder liner 1 and the cylinder block inner surface 9. The result is a cylinder liner 1 that cannot loosen or rotate within the cylinder block 5. Grooves 7 as shown in FIG. 3 are then machined into the cylinder block outer surface 10. FIG. 3 show six such grooves 7.

When the cylinder liner 1 is used in the dry system, coolant flows through channels in the cylinder block 8. The block 8 becomes cooler than the liner 1. The block 8 then, absorbs heat from the liner 1 through the surfaces of contact between the liner 1 and the block 8. These surfaces of contact are the entire block inner surface 9, and the entire outer circumferential surface 3 of the liner 1, which includes the ridges 6 and the grooves 5, 7.

For a wet system, the molten aluminum flows around the cylinder liner 1 and comes in contact only with the ridges 6. No aluminum flows into the longitudinal or annular grooves 5, 7. Thus, gaps, being the longitudinal and annular grooves 5, 7, are left between the cylinder liner outer circumferential surface 3 and the cylinder block inner circumferential surface 9. When the cylinder liner 1 is used in the wet system, a coolant passes through the longitudinal and annular grooves 5, 7.

While the present invention has been described in detail in relation to a preferred embodiment for use with an internal combustion engine, it will be readily appreciated to those skilled in the art that modifications and variations in addition to those mentioned above may be made without departing from the scope and spirit of the invention. Such modifications are to be considered as included in the following claims.

I claim:

1. A cylinder liner device comprising:

an elongate hollow cylinder having a smooth inner circumferential surface, an outer circumferential surface, and a length;

a plurality of longitudinal grooves in the outer circumferential surface extending linearly along the elongate hollow cylinder;

a plurality of annular grooves in the outer circumferential surface extending in a circumferential direction along the elongate hollow cylinder; and the longitudinal grooves intersecting the annular grooves to form a plurality of raised ridges which increase cooling capacity and increase locking ability of the liner within the block;

wherein said longitudinal grooves are perpendicular to said annular grooves; and the plurality of said longitudinal grooves and said annular grooves have equal depths and equal widths; and wherein said longitudinal grooves are spaced equally apart from each other; and wherein said annular grooves are spaced equally apart from each other; and a cylinder block surrounding said elongate hollow cylinder, said cylinder block having an inner surface and an outer surface; and said cylinder block inner surface being in direct contact with said ridges of the elongate hollow cylinder, whereby the cylinder liner is locked securely within the cylinder block and the cooling capacity of the device is increased; and whereby said ridges protrude into and are surrounded by the inner surface of the cylinder block and the cylinder block inner surface protrudes into the longitudinal and annular grooves of the elongate hollow cylinder whereby the ridges, longitudinal grooves, and annular grooves lock the cylinder liner securely within the cylinder block and also increase the area of the cylinder liner outer circumferential surface to provide increased cooling capacity.

2. A method of forming a cylinder liner comprising:

using a mold to cast an elongate hollow cylinder having a smooth inner circumferential surface, an outer circumferential surface, a length, and a plurality of longitudinal grooves in the outer circumferential surface extending linearly along the length of the elongate hollow cylinder; and machining a plurality of annular grooves in the outer circumferential surface extending in the circumferential direction along the elongate hollow cylinder and intersecting with the longitudinal grooves to form ridges.

3. The method as in claim 2 further comprising machining annular grooves of the same depth as the cast longitudinal grooves.

4. The method as in claim 2 further comprising:

placing the elongate hollow cylinder in a cylinder block mold; and pouring molten aluminum into the cylinder block mold to form a cylinder block.

* * * * *